US010435208B2

(12) United States Patent
Roy

(10) Patent No.: US 10,435,208 B2
(45) Date of Patent: Oct. 8, 2019

(54) CLOSURE

(71) Applicant: Reckitt Benckiser (Brands) Limited, Slough, Berkshire (GB)

(72) Inventor: Sukanta Roy, Haryana (IN)

(73) Assignee: RECKITT BENCKISER (BRANDS) LIMITED, Slough, Berkshire (GB)

( * ) Notice: Subject to any disclaimer, the term of this patent is extended or adjusted under 35 U.S.C. 154(b) by 10 days.

(21) Appl. No.: 15/324,224

(22) PCT Filed: Jul. 8, 2015

(86) PCT No.: PCT/GB2015/051977
§ 371 (c)(1),
(2) Date: Jan. 5, 2017

(87) PCT Pub. No.: WO2016/012749
PCT Pub. Date: Jan. 28, 2016

(65) Prior Publication Data

US 2017/0210521 A1 Jul. 27, 2017

(30) Foreign Application Priority Data

Jul. 22, 2014 (GB) ..... 1412940.7

(51) Int. Cl.
*B65D 50/04* (2006.01)

(52) U.S. Cl.
CPC ..... *B65D 50/043* (2013.01); *B65D 50/046* (2013.01)

(58) Field of Classification Search
CPC .. B65D 50/043; B65D 55/02; B65D 43/0225; B65D 50/046; B65D 50/048; B65D 41/06; B65D 41/04
(Continued)

(56) References Cited

U.S. PATENT DOCUMENTS 3,984,021 A 10/1976 Uhlig
3,993,209 A 11/1976 Julian
(Continued)

FOREIGN PATENT DOCUMENTS

FR 2269459 A1 11/1975
FR 2414005 A1 8/1979
(Continued)

OTHER PUBLICATIONS

International Search Report and Written Opinion of the International Searching Authority for corresponding application PCT/GB2015/051977 dated Sep. 16, 2015.
(Continued)

*Primary Examiner* — Anthony D Stashick
*Assistant Examiner* — Raven Collins
(74) *Attorney, Agent, or Firm* — Norris McLaughlin, PA

(57) ABSTRACT

An improved closure adapted for use with a suitably configured dispensing container the closure comprising as parts of a single sidewall; a compressible main body part having a sidewall having disposed thereon and/or formed within one or more gripping means, a set of mating threads upon the interior of the sidewall, and a base edge, a distensible base skirt part which depends from the main body part by connecting cowling sections, the base skirt part comprising sidewall rim regions which are connected to the cowling sections but separated from the main body part by arcuate perforations in the region between the cowling sections and a base edge of the main body part, and further a catch pawl present within the cowling section. The closure provides for controlled removal of the closure from the dispensing container.

15 Claims, 4 Drawing Sheets

(58) Field of Classification Search
USPC ..... 215/272, 216, 201, 332, 329, 316; 220/281, 302, 301, 300, 293, 288
See application file for complete search history.

(56) References Cited

U.S. PATENT DOCUMENTS

| | | | | |
|---|---|---|---|---|
| 5,722,546 | A | 3/1998 | Briere | |
| 5,836,466 | A | 11/1998 | Briere et al. | |
| 8,245,880 | B1 * | 8/2012 | Bragg | B65D 47/242 215/216 |

FOREIGN PATENT DOCUMENTS

| | | | |
|---|---|---|---|
| FR | 2572369 | A1 | 5/1986 |
| GB | 1521201 | | 8/1978 |
| NL | 7505172 | | 11/1975 |
| WO | 2009103947 | A1 | 8/2009 |
| WO | 2013064790 | A1 | 5/2013 |

OTHER PUBLICATIONS

GB Search Report for corresponding application GB 1412940.7 dated Sep. 24, 2014.
GB Search report for corresponding application GB 1412940.7 dated Sep. 24, 2017.
GB Combined Search and Examination Report for corresponding application GB 1412940.7 dated Sep. 24, 2014.
AU Examination Report for corresponding application AU 2015293666 dated Mar. 26, 2019.
Translation of RU Office Action for corresponding application RU 2017105351 dated Feb. 5, 2019.

* cited by examiner

CLOSURE

This is an application filed under 35 USC 371 of PCT/GB2015/051977, filed 8 Jul. 2015, which in turn is based on GB 1412940.7 filed 22 Jul. 2014. This application claims the full priority benefit to the foregoing applications, and also incorporates the entirety of their disclosures as if set forth herein.

The present disclosure relates to dispensing containers used to contain, and when necessary, dispense a quantity of a fluid, preferably a liquid composition therefrom, and an associated closure which may be removably affixed from an open part, e.g. a neck, of the dispensing container through which a fluid may be dispensed. More pertinently the present invention relates to a closure which may be removably affixed to such a dispensing container, e.g, a flask or bottle.

Many products, including but not limited to household cleaning products, are provided in a non-pressurized container, such as a flask, bottle, and the like which are sealed with a closure. In certain instances, the closure includes one or more elements or features which control the manner in which the closure can be removed from the container. Such features may for example, be provided with the purpose of denying easy access to the contents of the flask by persons who may understand the manner of use of the product within the container, e.g. children. Admittedly a plethora of such closures having such elements or features are known. However is many instances such closures are complicated, and are difficult to manufacture particularly large quantities, due to their particular configurations which include such additional elements or features.

One such closure having such features is disclosed in Figures A and B, which respectively depict an underside plan view, and a cross-section of an elevation view of a prior art closure (a), which is presently publicly available. The depicted closure is presently sold as part of a dispensing container package which comprises both a flexible flask formed of a polymeric material having a threaded neck and a pair of extended lugs which extend from an upper surface of the flask and adjacent to, or alternately in the near proximity of the base of the threaded neck, and the disclosed dual-walled dispenser closure. As is visible from FIG. A, the interior surface of the inner wall (b) includes a series of threads (c) which are configured to be engageable with a set of corresponding threads present upon a neck (not shown) of the flask, and outwardly from the inner wall, an exterior wall (d) which is for the most part, separated from the inner wall. Extending inwardly from an inner surface of the exterior wall are a pair of diametrically spaced apart pawls (e) which they be engaged with one or more of the lugs present upon the upper surface of the flask. In use, the closure is mounted upon that the dispensing container such that the threaded neck engages the series of threads on the inner wall of the closure, and the closure is rotated in the direction of the flask until the closure is seated upon the open end of the neck, and simultaneously at least a part of the pawls of the inner surface of the exterior wall are positioned in the same transverse horizontal plane as at least a part of the extended lugs. Typically, during such a rotating engagement, as the pawls descend towards the lugs and come into rotational engagement there with, the exterior wall is radially distended from the position as shown in FIGS. A and B such that the base of the exterior wall temporarily assumes an elliptical configuration. Such provides for sufficient mechanical clearance such that the distended exterior wall and the depending pawls may come to physical contact with, but be rotated past the extended lugs. As is visible on FIG.

A, the configuration of the pawls are such that in one rotational direction, here a clockwise rotational direction, a flat surface is presented at the tangent to the inner surface of the exterior wall, while at the opposite side from this flat surface, the pawls present a contact point or lobe which is essentially or nearly perpendicular to the most proximate position at the inner surface of the exterior wall. This latter position corresponds to the counterclockwise rotational direction, with the purpose of such configuration being that when the mounted closure is rotated in such a counterclockwise rotation in order to remove the closure from the neck, the pawls will engage and stopped the counterclockwise rotational motion of the closure as the contact point or lobe of each comes into engagement with, e.g. abuts, one or both of the extended lugs. The closure may only be removed from the flask, in this counterclockwise rotation, if outward pressure is used to distend the exterior wall of the closure such that the contact point or lobe of each of the pawls are sufficiently moved away and no longer engaged the extended lugs as the closure is rotated. Such permits for the (reversible) removal of the closure from the neck of the flask, and permits for the dispensing of any contents or materials within the flask outwardly from the open end of the neck. Although such a closure is very effective for its intended purpose, the provision and requirement of a dual-wall design also requires for a relatively complicated die to be used when such a closure is formed from a thermal plastic synthetic polymer material, which is typically used to produce such a closure via a conventional injection molding process.

Thus, notwithstanding the availability of certain closures which are useful for providing controlled/controllable access to the contents of an associated dispensing container, there still remains a real need in the relevant art for improved closures which are useful in conjunction with a dispensing container. It is to these and further objects that the present invention is directed.

In a first aspect the present invention provides an improved closure which may be used in conjunction with a suitably configured dispensing container.

In a second aspect the present invention provides an improved closure, which may be removably mounted upon a suitably configured dispensing container.

In a third aspect the present invention provides an improved closure, which may be fixable to a suitably configured dispensing container, and through which closure a quantity of a composition may be dispensed without requiring the complete removal of the improved dispensing device closure from the dispensing container or part thereof.

In a fourth aspect the present invention provides a dispensing container package which comprises both a dispensing container, e.g. a flask, having a threaded neck and at least one extended lug which extends from an upper surface of the flask and is adjacent to, or alternately in the near proximity of, the base of the threaded neck, and an improved closure as described herein.

In a fifth aspect there is provided an improved method for dispensing a composition from a dispensing container package, which method includes the steps of providing and/or utilizing a suitably configured flask having a threaded neck and at least one extended lug which extends from an upper surface of the flask and is adjacent to, or alternately in the near proximity of, the base of the threaded neck, with an improved closure as described herein, and utilizing the dispensing container package to dispense a quantity of a fluid, preferably liquid composition, therefrom.

In a sixth aspect there is provided as a vendible article, an improved dispensing device closure as described herein.

In a seventh aspect is provided as a vendible article, a dispensing container package which comprises a suitably configured flask, in conjunction with an improved dispensing device closures described herein.

In an eighth aspect there is provided a method of inhibiting the undesired dispensing of a fluid composition from a dispensing container, which method comprises the step of providing answer/or utilizing an improved dispensing device closure as described herein.

These and further aspects of the invention are described in the further parts of this patent specification.

FIG. 1. depicts in perspective view an embodiment of a closure of the invention, mounted upon a bottle.

Broadly stated the improved closure adapted for use with a suitably configured dispensing container the closure comprising as parts of a single sidewall; a compressible main body part having a sidewall having disposed thereon and/or formed within one or more gripping means, a set of mating threads upon the interior of the sidewall, and a base edge; a distensible base skirt part which depends from the main body part by connecting cowling sections, the base skirt part also comprising sidewall rim regions which are connected to the cowling sections but separated from the main body part by arcuate perforations in the region between the cowling sections and a base edge of the main body part, and further a catch pawl present within the cowling section. The improved closure is adapted to be used in conjunction with a suitably configured dispensing container, e.g, a flask, which dispenser package may be provided as part of a vendible article.

Figure 1:
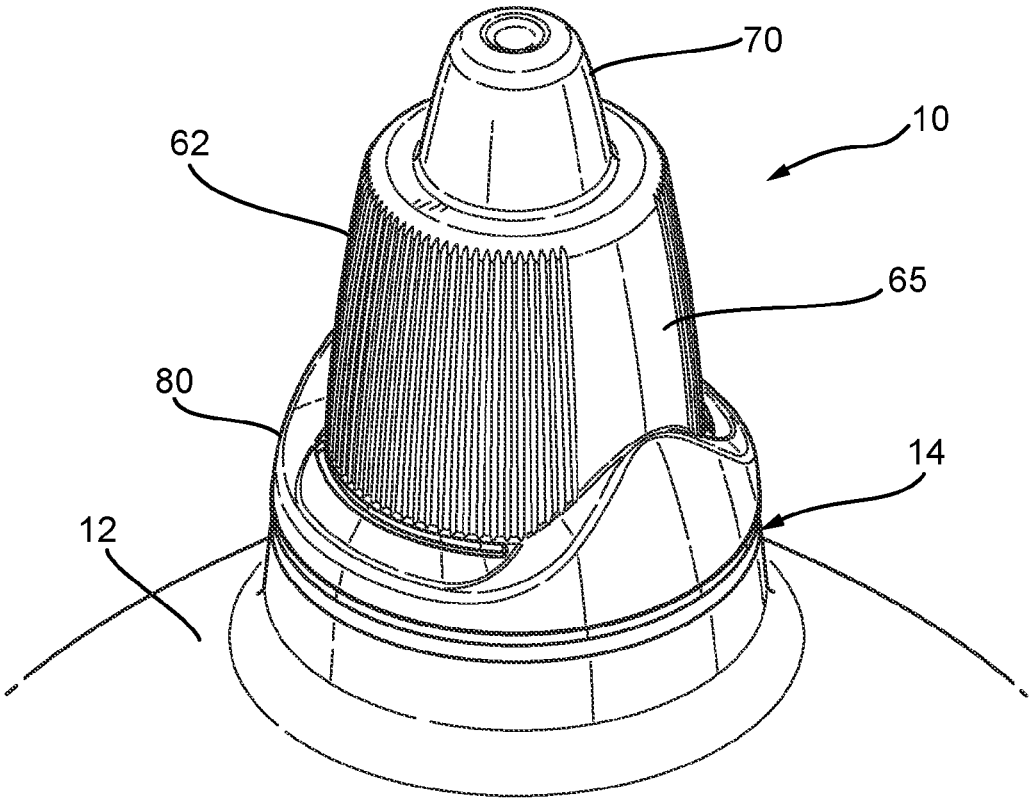
Figure 4:
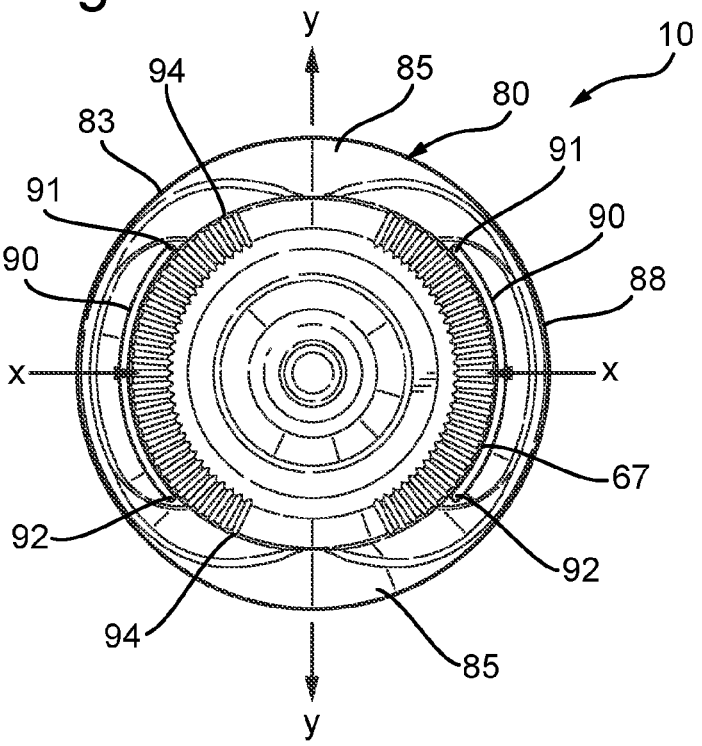
FIG. 4 depicts a top plan view of the closure shown on FIG. 1.
Figure 5:
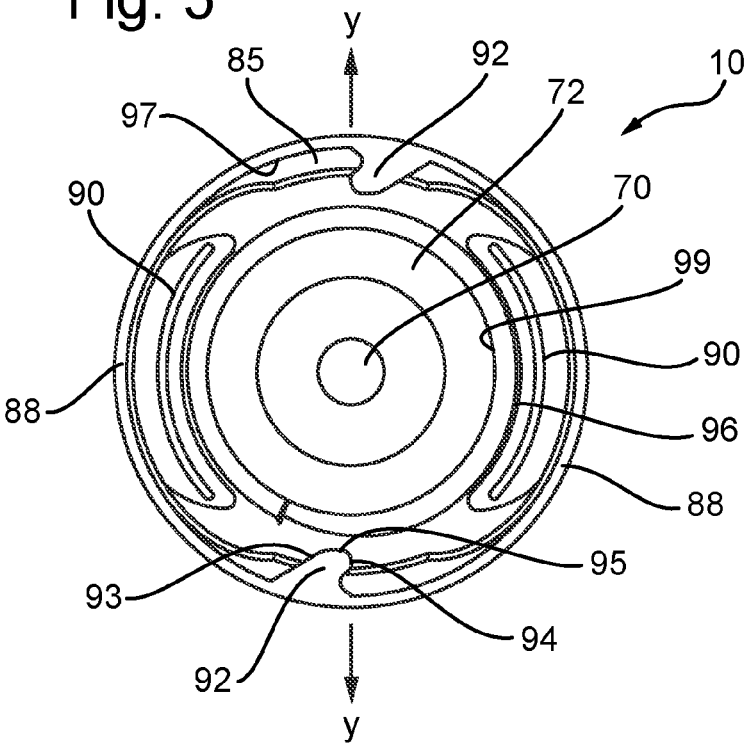
FIG. 5 depicts a plan view of the underside of the closure of FIG. 1
Figure 6:
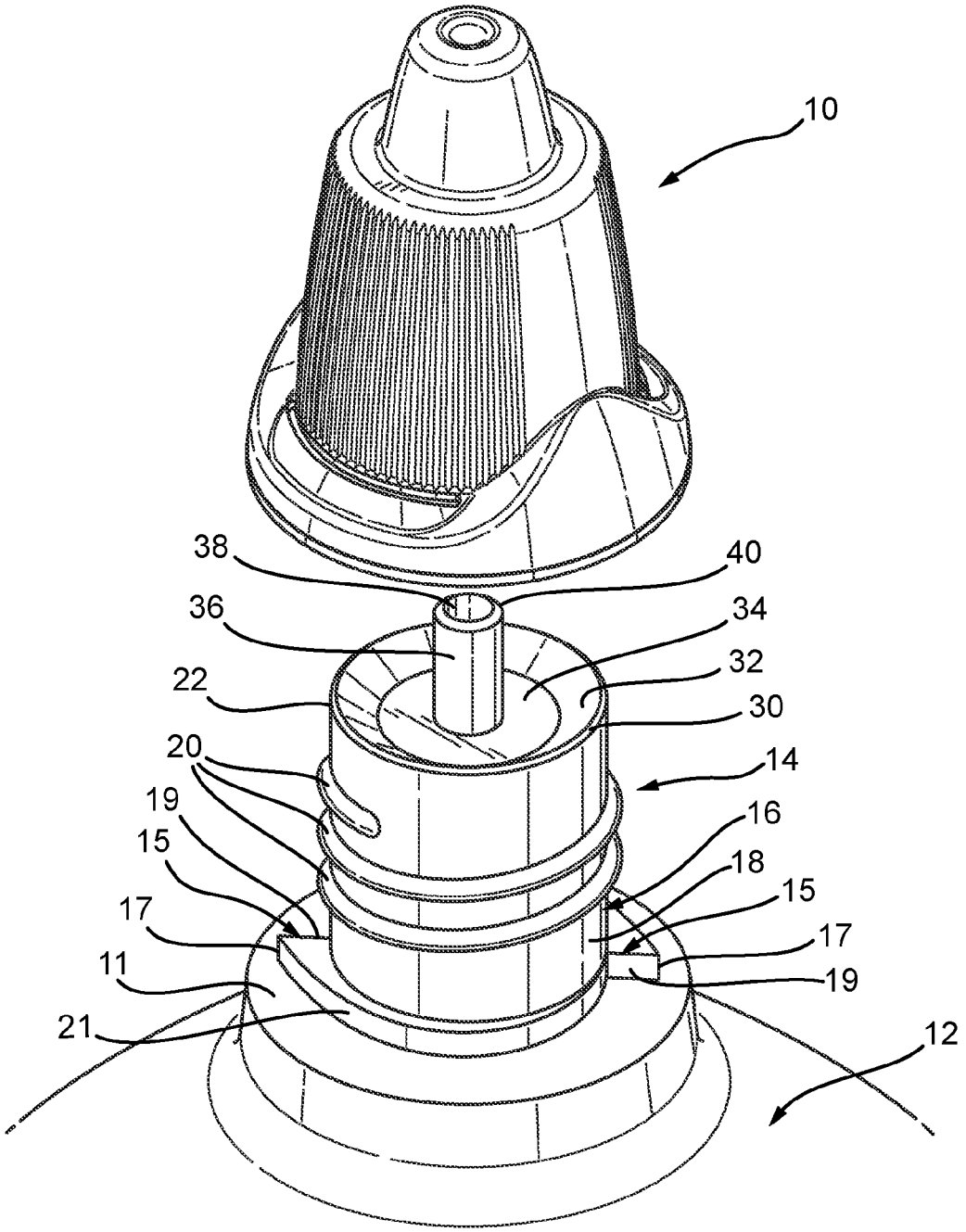
FIG. 6 depicts a perspective, exploded view of the closure of FIG. 1, and a portion of the bottle of FIG. 1, showing certain details of the neck part thereof.

The closure of the present invention is depicted in various views on FIGS. 1, 2, 3, 4, 5 and 6. FIG. 1 depicts the inventive closure 10 mounted upon a part of flask 12, in particular upon the neck part 14 of the flask 12 and represents when that the closure 10 and flask 12 in a "closed" or "sealed" configuration, in which configuration the contents contained within the flask 12 are denied egress from the flask 12 due to the presence of the closure 10. FIG. 6 depicts the closure 10 and flask 12, but in an alternative configuration wherein it these two elements completely separated to thereby provide a better view of the corresponding features of the flask 12, and in particularly the neck part 14. With reference to FIG. 6, the neck part 14 of the flask 12 provides a passage or conduit through which the contents of the flask 12 may be dispensed outwardly from the flask 12. The neck part 14 comprises a cylindrical neck 16 having on its exterior sidewall 18 a set of threads 20 extended outwardly, for at least a part of the exterior sidewall 18. At the top 22 of the neck 16 is provided an opening, which may as depicted herein include a fitment 30 which is inserted within the neck 16 and is in a liquid tight relationship there with. The fitment 30 includes a sidewall 32 which is configured to fit within the neck 16 preferably by a friction fit. The fitment 30 includes a base part 34 which is generally perpendicular to the neck 16, and is also generally perpendicular to the nozzle 36 which is essentially a hollow tube which extends outwardly from the base part 34 and which terminates at a nozzle end 38 having a nozzle opening 40. According to the depicted embodiment, when did the closure 10 is fully disengaged from the neck part 14 of the flask 12, the flask may be tilted, inverted, or any other configuration whereby any fluid, especially liquid contents of the flask 12 may exit the flask 12 through the nozzle 36 and its nozzle opening 40. Such may be facilitated by manual compression of the flask 12 which is advantageously deformable, such as a flask 12 formed from a plastics material. Such compression of the flask increases the internal pressure of the flask 12 and urges any of its contents outwardly therefrom.

It is to be nonetheless understood that the embodiment of FIG. 6 depicts a configuration where a (preferred) fitment 30 is present within the neck part 14, however such is to be understood as being an optional element, as the features of the inventive closure 10 are fully operative even in absence of such a fitment 30.

As is further visible from FIG. 6, the neck part 14 extends upwardly from a base part 11 which is preferably generally planar and also preferably generally perpendicular to a centerline or rotational axis of the neck 16. In the depicted embodiment a pair of stop elements 15 are also present, and extend upwardly from the base part 11 in the direction of the neck 16. The stop elements 15 as they extend upwardly from the base part 11 have a height which is shorter than the distance of the top 22 of the neck from the base part 11, and preferably are substantially shorter, e.g, are not more than $1/10^{th}$ of this later height, more preferably are not more than $1/12^{th}$ of this latter height. As is also seen, each of the stop elements 15 include a protrusion 17 which extends outwardly from the exterior sidewall 18 such that the transverse distance between the outermost parts of each protrusion 17 are necessarily greater than that the maximum exterior diameter of the neck 16. In the depicted embodiment, the protrusion 17 also include a face part 19 which is a generally planar, is preferably generally perpendicular to base part 11 and also extends radially outwardly from the neck 16. In this depicted embodiment, there is also present in arcuate connecting wall 21 which extends between each of the protrusions, and which curves outwardly from the exterior sidewall 18. As shown, the curvature of each of the arcuate connecting walls 21 is equal to, or greater than the radius of the exterior sidewall 18 of the neck 16. Preferably, is also shown each of these arcuate connecting walls 21 begins at a point wherein the face part 19 of a protrusion 17 intersects or is proximate to the neck 16 in particular the exterior sidewall 18 thereof, and extends to comment terminates at the outermost part of an adjacent protrusion 17, particularly at a face part 19 (or edge of a face part 19) which is most a distal to the neck 16 and in particular the exterior sidewall 18 thereof. When present, such arcuate connecting walls 21 are preferably integral parts of the flask 12. The provision of arcuate connecting walls 21, although optional, is strongly preferred as such facilitates the cooperative engagement of the closure 10 and that the neck 14 particularly when the closure is rotated such that it is used to seal the flask 12 and assumes a position according to FIG. 1.

Figure 2:
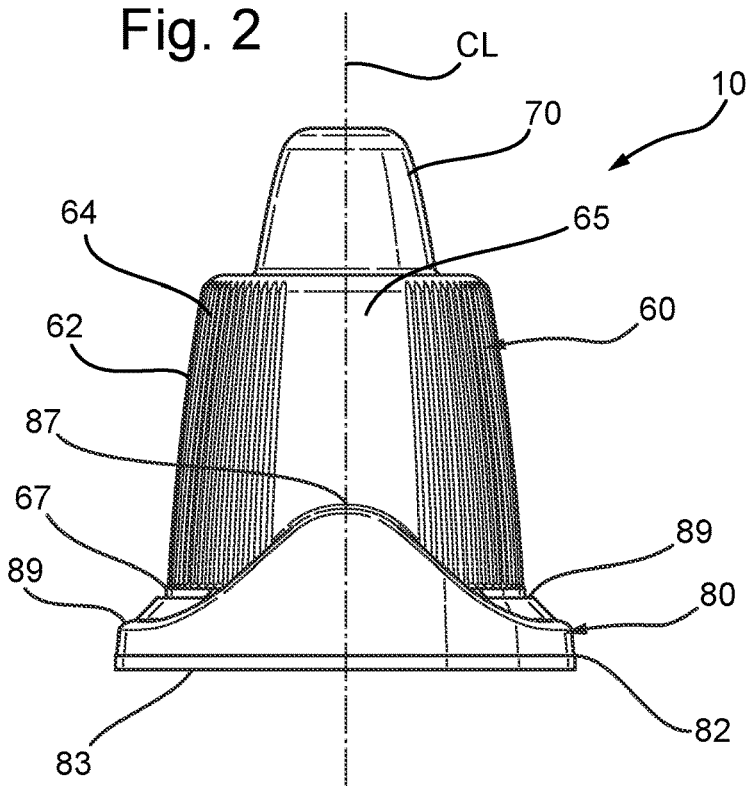
FIG. 2 depicts a first elevational view of the closure shown on FIG. 1.
Figure 3:
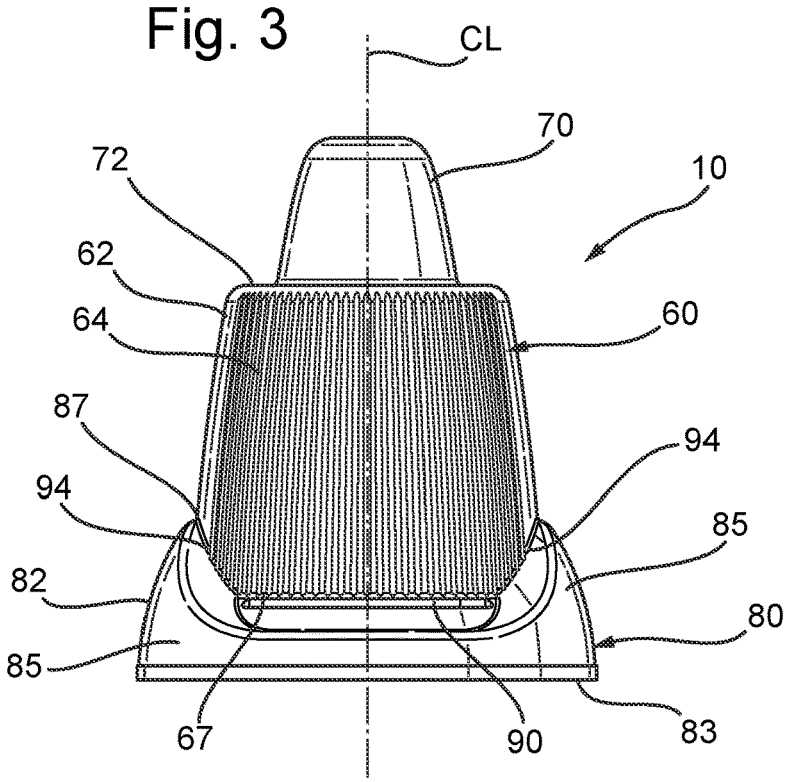
FIG. 3 depicts a second elevational view of the closure shown on FIG. 1.

As is seen from FIGS. 1, 2 and 3, the closure 10 includes a main body part 60 which comprises a sidewall 62 having disposed thereon and/or formed within one or more gripping means 64, here depicted as regions of sets of parallel spaced apart recesses which can be integrally molded within the closure 10. Such gripping means 64 facilitates the user of the closure 10 to properly grasp the closure in an appropriate manner. As is further seen, the gripping means are separated by a divider part 65, which is a portion of the sidewall 62 wherein gripping means 64 are absent. Upwardly from the main body part 60 is a closure tip part 70 which extends upwardly from a tip base 72 which is preferably generally planar, and also perpendicular to a centerline "CL" about which both of the tip part 70 and tip base 72 are generally concentric. Preferably also, most of the main body part 60 is also generally concentric with respect to the center line CL as well. At the opposite end from the tip part 70, the closure 10 includes a base skirt part 80 which depends from the main body part 60, and which is distal from the tip base 72.

With additional reference now to FIG. 4 which illustrates a top plan view of the closure 10, the details of the base skirt part 80 will now be explained. The base skirt part 80 includes a sidewall 82 which depends from parts of the main body part 60. The base skirt part 80 extends at least partially outwardly and downwardly from the main body part 60 and terminates in a base edge 83 which is preferably generally circular. In the depicted embodiment, the base skirt part 80 is separated from the base edge 67 of the main body part 60 by a pair of arcuate perforations 90. Each of the arcuate perforations 90 are coincident with parts of base edge 67 and form of physical gap with the adjacent parts of the base skirt part 80. Each of the arcuate perforations 90 include two ends 91, 92 intermediate of with each can be defined the length of the arcuate perforation 90. Alternatively, the length of each of the arcuate perforations 90 can be defined by the radial degrees which are encompassed by each of the arcuate perforations, in view of the fact that, as is clearly visible in FIG. 4, the base skirt part 80, the main body part 60 and the arcuate perforations 90 are all concentric about the axis of the center line CL (depicted on FIGS. 2 and 3). Thus in preferred embodiments, each of the arcuate perforations 90 extends between 10-175 degrees of arc, more preferably between 20-130 degrees of arc, still more preferably between 25-105 degrees of arc, yet more preferably between about 30-90 degrees of arc, and especially preferably between about 30-70 degrees of arc. As is further seen from FIGS. 1, 2, 3 and 4, and particularly from FIG. 4, the base skirt part 80 is affixed to and depends from the main body part 60 at parts thereof which are not separated by arcuate perforations 90. With reference to FIG. 4 such are connection regions 94 wherein the main body part 60 is attached to the base skirt part 80, which connection regions 94 or intermediate the ends of two adjacent arcuate perforations 90 However, the specific dimension and configuration of these connection regions 94 may vary.

With particular reference to FIGS. 1, 2 and 3, the base skirt part 80 is preferably tapered, and extends outwardly from the main body part 60, and the diameter of the base edge 83 is greater than the diameter of the base edge 67 of the main body part 60. Advantageously, the diameter of the base edge 83 is at least 1.05-1.5 times, more preferably is 1.1-1.35 times the diameter of the base edge 67. Preferably also, the diameter of the base edge 83 is at least equal to, or may be greater than that of the maximum cross-sectional dimension, e.g, diameter of the base part 11 of the flask 12. In such a preferred configuration then, the base skirt part 80 encompasses and covers the stop elements 15 as they extend upwardly from the base part 11 of the flask 12 as depicted on FIG. 1. This feature is facilitated by a configuration of the base skirt part 80 as disclosed in these Figures, wherein may be seen it that the base skirt part 80 includes two diametrically opposed cowling sections 85 which are parts of the base skirt part 80 are connected to (or integrally connected with) parts of the main body part 60 at regions between adjacent arcuate perforations 90. Each of the cowling sections 85 extend between the base edge 83, and extend upwardly (viz., in the direction of the tip part 70) to a part of the main body part 60, preferably is shown, wherein they terminate at a cowling peak 87 which is intermediate the base edge 67 of the main body part 60, and the tip base 72, preferably however the cowling peak 87 is lower than the midpoint between the tip base 72 and the base edge 67. In preferred embodiments, shown in the figures, the position of each cowling peak 87 is generally positioned at a midpoint or equal distance from the ends 91, 92 of the adjacent arcuate perforations 90 between which the cowling peak 87 is situated. The height of the cowling sections 85 may advantageously decrease from their maximum height dimension (viz, distance from the base edge 83) to a lower or minimal height as it extends radially away from this maximum height dimension. The base skirt part 80 also includes two sidewall rim regions 88 which are also transverse with and opposed to each other, as is best seen on FIG. 4. Each of the sidewall rim regions 88 are intermediate adjacent cowling sections 85 and are also adjacent to and arcuate perforation 90. Each of the sidewall rim regions 88 provide a connecting element between adjacent cowling sections 85. While not essential, it is however preferable that the top surface 89 of each of the sidewall rim regions 88 have a maximum height dimension which is less than distance of the base edge 67 of the main body part 60 from the base edge 83 of the base skirt part 80. This in turn provides that upon the exertion of a manual compressive force, (e.g, the compression between two fingers such as forefinger in the thumb of a human hand) upon the main body part 60 of the closure 10, which causes deformation and a degree of distention to be introduced into the closure 10, that the top surface 89 may by eclipsed by a part or parts of the base edge 67. With such a consideration mind, it is therefore also particularly preferred that a part of, preferably major part of the cowling sections 85 are oriented with respect to the main body part 60 such that the cowling peak 87 is positioned with a divider part 65 which may be present between adjacent gripping means 64 when such a divider part 65 is present. Where such a divider part 65 is present, and divides separates adjacent regions of gripping means 65 present upon a main body part 60, such facilitates the proper grasping, and compression of the closure 10, so that it may be properly removed from a neck 14 of a flask 12 as depicted on FIG. 6.

FIG. 5 depicts a plan view of the underside and interior of the closure according to FIGS. 1, 2, 3, 4 and 6. As is visible therefrom, extending inwardly in depending from a part of the base skirt part 80, and in particular from a part of the inner sidewall 97 of the base skirt part are a pair of diametrically opposed catch pawls 92. Each of these pawls 92 include a pawl tip 95 which is perpendicular to the inner sidewall 97, and includes a catch face 94 which extends from one side of the pawl tip 95 to the inner sidewall 97, and a sloped face 93 at the other side of the pawl tip 95 which extends from the pawl tip 95 to the inner sidewall 97 of the base skirt part 80. Advantageously, the catch face 94 is generally perpendicular to the curved inner sidewall 97, whereas the slope face 93 is not perpendicular, preferably has a slope of at least 30 degrees of arc with respect to the curved inner sidewall 97 where it intersects there with. The dimensions of the catch pawls 92 and in particular the distance between their pawl tips 92 and/or the distance between each of the pawl tips 92 and the curved inner sidewall 97 from which they may depend are such that when the closure 10 is mounted upon that the flask 12 as shown in FIG. 6, that the distance between their pawl tips 92 is less than the distance between the outermost extent of the protrusions 17 which extend outwardly from the exterior sidewall 18 of the neck 16. In this manner, when the closure 10 is fully mounted upon the flask 12, as per FIG. 1, the pawl tips 92 will extend inwardly towards the neck 16 and when the closure 10 is rotated, the pawl tips 92 and/or the catch face 94 comes into physical contact, e.g, abutment, with the protrusions 17, particularly and preferably the face part 19 thereof.

An important and advantageous technical feature the present invention resides in the fact that unlike the prior closure depicted on FIGS. A and B which was essentially of a dual-wall construction, the closure 10 of the present invention can be formed with a single, continuous wall which is configured as described herein. Whereas the prior art closure required a generally separate, first inner wall (b) which comprised a series of threads (c) which were engageable with a set of corresponding threads present upon a neck of a flask, and a second, generally separate exterior wall (d) which encased the first inner wall (b) and from this exterior wall (d) were present spaced apart pawls (e), these limitations are surprisingly and unexpectedly overcome by the present invention. In the prior art closure, the separation of the inner wall (b) from the exterior wall (d) was necessitated as the required compression of that closure order to distend the pawls (e) would only work wherein the wall of the closure was separate from the wall which bore the threads (c), as if such a compressive force were imparted on the inner wall (b) the ability to rotate and remove the closure would be defeated. This has however been overcome by closures according to the present invention, which do not have a separate inner wall (b) and a separate outer wall (d). but which in preferred embodiments includes a single exterior wall, having separate parts/regions as discussed herein and disclosed with reference to the drawing figures. The closure the present invention are effective, may be produced at reduced material costs, all without a significant compromise as to their functionality.

The closure the present invention may be produced from any suitable material, and in this respect moldable, especially thermoformed synthetic polymer materials are particularly preferred. Nonlimiting examples of suitable materials include polymers, particularly synthetic thermoplastic or thermosetting polymers, including but not limited to: polyamides (e.g., Nylon), polyolefins (e.g., polypropylene, polyethylene, HMWPE, LDPE) as well as polyalkylene-terephalates (i.e., polyethylene terephthalate, polybutylene terephthalate), polystyrenes, polysulfones, polycarbonates as well as copolymers formed from monomers of one or more of the foregoing being several nonlimiting examples of useful synthetic polymers. When formed of such materials, the inventive closures any proposed by conventional fabrication processes including but not limited to thermoforming, injection molding, stamping, compression, and the like.

The closures of the present invention are use conjunction with a suitable container, e.g. a flask, bottle, and the like. Such containers are generally nonpressurized, such that the interior contents of these containers are at ambient or atmospheric pressure both when stored, and when used to dispense a fluid, preferably a liquid product, contained within. Advantageously, the dispensing containers, e.g, flasks, are formed of a material such that they may be compressed, if desired in order to increase the internal pressure when dispensing a quantity of their contents if so desired. Which such containers can be suitably formed from any suitable material of construction, Advantageously such containers are formed from or include thermoformed synthetic polymer materials which are resistant to many commercial product, such as household cleaning products which may be neutral, acidic, or basic in character. Advantageously, such synthetic polymer materials include those described above useful in the fabrication of the closures described herein. Further preferably, the container includes one or more parts and/or elements which are discussed herein and especially with reference to FIG. 6.

Any of a variety of liquids may be stored within and when required dispensed from the dispensing containers provided with a closure as described herein. Such include, e.g., surface treatment products including those which provide a cleaning and/or sanitizing and/or disinfecting benefit, particularly when used in the treatment of inanimate hard surfaces, (e.g, non-porous) and for soft surfaces (e.g. textile articles, garments, carpets, etc.). The liquids stored and dispensed from dispensing containers having closures as described herein may be used with, without further dilution. In the case of the latter, it may be advantageous to include a flow directing element or nozzle (e.g, a fitment 30 inserted within the neck of the dispensing container) but such is usually not required necessary wherein the liquids dispensed are used to form dilutions therefrom.

In use, closures of the invention may be mounted upon a dispensing container 12. e.g. flask, as shown in FIG. 1. With reference to FIGS. 5 and 6, as the closure 10 is placed upon the neck part 14, corresponding mating threads 99 present upon the interior 96 of the sidewall 62 of the main body part 60 are positioned to engage threads 20, and the closure 10 is rotated with respect to the neck part 14 and the container 12, during which time the base skirt part 80 and its base edge 83 comes into proximity with the base part 11 and the protrusions 17. As rotation continues (usually in a clockwise orientation) the protrusions come into engagement with parts of the pawls 92. During subsequent rotation, the pawl tips 95 come into sliding contact with the protrusions 17, (and when present, at least a part of the arcuate connecting wall 21) which contact causes the base skirt part 80 and a part of its base edge 83 to distend outwardly, in the direction of the arrows labeled "y" on FIGS. 4 and 5. Such a distended condition is maintained until the pawl tip 92 is moved beyond the maximum extend of the protrusion 17 from the neck 16, wherein the stresses imparted within the closure 10 are reduced and the base skirt part 80 and its base edge 83 return to an unstressed configuration as depicted on FIGS. 4 and 5. Rotation of the closure 10 onto the dispensing container 12 continues until the closure 10 is fully seated, as depicted on FIG. 1. In this position, desirably the orientation of the closure 10 with respect to the container 12 is such that the pawls 92 are positioned somewhere intermediate adjacent protrusions 17, such that the internal stresses within the closure are minimized or removed. The closure 10 may be removed from the dispensing container 12 by contra-rotation. In such a process, a user or consumer imparts pressure transversely across the main body part 60 of the closure 10 by applying a compressive force at a position intermediate the location of the pawls 12 present on the underside and/or/interior of the skirt part 80, as represented by directional arrows labeled "x" on FIG. 4. Such a compression imparts flexural stress and deformation (tension) of parts of the closure 10, and in particular causes the distance between the pawl tips 95 to increase preferably to extend and to move outwardly in the direction of arrows "y". Due to the provision of the arcuate perforations 90, while parts of the main body part 60 are compressed inwardly (arrows labeled "x") such compression also causes the linear distance between the ends 91, 92 of the arcuate perforations 90 to increase which is due in part to the presence of the rim regions 88 which urge the movement of the ends 91, 92 away from one another, as each rim region is also extended in length during compression and urge the cowling sections 85 to also move outwardly (in the direction of arrows "y"). The provision of both the arcuate perforations 90 and the corresponding rim regions 88 provides such a feature which, and which arcuate perforations 90 and corresponding rim regions 88 may be included in the same wall of a closure as the mating threads 99 used to engage with the dispensing container 12, and not require separate walls. The separation of part of the base skirt part 80, from the main body part 60 by virtue of the arcuate perforations 90 provides for such relative movement and positioning of parts of the closure 10 is now achieved, without requiring separate walls, viz., in a closure having a single sidewall. Compression of the closure 10 and distension of some of its parts/elements is advantageously maintained upon parts of the main body part 60, while the closure 10 continues to be rotated, preferably at least until the pawls 92 no longer come into contact with any part of the protrusions 17, during which compression may be lessened or removed from the closure, and the counter rotation continued until the closure 10 is separated from the neck part 14.

While the foregoing description, copying figures disclose a particular preferred embodiment of a closure according to invention, as well as a dispensing container package which comprises both a dispensing container and a closure, it is to be understood that a skilled artisan majors one or more variations it still fall within the scope of the present invention. For example, the closure may be provided with one, two (as shown), three or more of: pawls 92 and/or arcuate perforations 90 and/or gripping means 64 and/or cowling sections 85. Similarly a dispensing container 12 may include one, two (as shown), three or more of: protrusions 17 and/or arcuate connecting walls 21.

The invention claimed is:

1. A closure adapted for use with a suitably configured dispensing container, the closure comprising as parts of a single sidewall;

a compressible main body part having a sidewall having disposed thereon and/or formed within one or more gripping means, a set of mating threads upon the interior of the sidewall, a base edge, a distensible base skirt part which depends from the main body part by connecting cowling sections, the base skirt part comprising sidewall rim regions which are connected to the cowling sections but separated from the main body part by arcuate perforations in the region between the cowling sections and the base edge of the main body part, and, a catch pawl present within the cowling sections and apart from the arcuate perforations.

2. The closure according to claim 1, wherein cowling sections are diametrically opposed with respect to one another.

3. The closure according to claim 1, wherein catch pawls are diametrically opposed with respect to one another.

4. The closure according to claim 1, wherein arcuate perforations are diametrically opposed with respect to one another.

5. The closure according to claim 1, wherein the arcuate perforations extend between 10-175 degrees of arc.

6. A closure adapted for use with a dispensing container, the closure comprising as parts of a single sidewall;

a compressible main body part having one or more gripping means disposed thereon and/or formed within, a set of mating threads upon an interior of the sidewall, a base edge, a distensible base skirt part, the distensible base skirt part comprising two cowling sections, each of which depends from the compressible main body part; sidewall rim regions which are connected to the two cowling sections but separated from the base edge of the compressible main body part by two arcuate perforations; and two catch pawls, each being present below a cowling section.

7. The closure according to claim 6, wherein the two cowling sections are diametrically opposed with respect to one another.

8. The closure according to claim 6, wherein the two catch pawls are diametrically opposed with respect to one another.

9. The closure according to claim 6, wherein the two arcuate perforations are diametrically opposed with respect to one another.

10. The closure according to claim 6, wherein the arcuate perforations extend between 10-175 degrees of arc.

11. A closure for a liquid dispensing container, the closure comprising:

a closure tip part having a tip base;

a main body part extending downwardly from the tip base and having disposed thereon and/or formed within one or more gripping means; and a base skirt part which depends from the main body part, the base skirt part comprising two cowling sections, each of which depends from the main body part; sidewall rim regions which are connected to the two cowling sections but separated from the main body part by two arcuate perforations; and two catch pawls, each being present below a cowling section.

12. The closure according to claim 11, wherein the two cowling sections are diametrically opposed with respect to one another.

13. The closure according to claim 11, wherein the two catch pawls are diametrically opposed with respect to one another.

14. The closure according to claim 11, wherein the two arcuate perforations are diametrically opposed with respect to one another.

15. The closure according to claim 11, wherein the arcuate perforations extend between 10-175 degrees of arc.

* * * * *